United States Patent [19]

Kudou

[11] Patent Number: 4,695,042

[45] Date of Patent: Sep. 22, 1987

[54] LANCE SUPPORTING APPARATUS

[75] Inventor: Takenori Kudou, Oita, Japan

[73] Assignee: Nippon Steel Corporation, Tokyo, Japan

[21] Appl. No.: 840,276

[22] Filed: Mar. 17, 1986

[30] Foreign Application Priority Data

Apr. 2, 1985 [JP] Japan ..... 60-68394

[51] Int. Cl.[4] ..... C21C 5/30

[52] U.S. Cl. ..... 266/226; 266/208

[58] Field of Search ..... 266/208, 209, 210, 211, 266/212, 226

[56] References Cited

U.S. PATENT DOCUMENTS 3,212,882 10/1965 Garfinkle ..... 266/226
3,756,584 9/1973 Mevissen ..... 266/142
4,139,185 2/1979 Henryson ..... 266/226

FOREIGN PATENT DOCUMENTS 2755738 6/1978 Fed. Rep. of Germany .
1106839 8/1984 U.S.S.R. ..... 266/208

*Primary Examiner*—L. Dewayne Rutledge
*Assistant Examiner*—Robert L. McDowell
*Attorney, Agent, or Firm*—Pollock, Vande Sande & Priddy

[57] ABSTRACT

A lance supporting device has a lance turntable rotatable within a plane and carrying a plurality of lance operation units each supporting a lance for inserting a gas and/or a powdered treating agent into a molten metal. Each lance operation unit has means for lifting/-lowering, rotating and tilting the lance. The lance turntable carrying the plurality of lance operation units is disposed in the central hollow or cavity of a doughnut-shaped turntable which carries a plurality of vacuum degassing vessels.

1 Claim, 6 Drawing Figures

LANCE SUPPORTING APPARATUS

BACKGROUND OF THE INVENTION

The present invention relates to a lance supporting apparatus for supporting a lance which is used in injecting a gas or a gas and a powdered treating agent (referred to as "powder", hereinunder) into a molten metal.

Japanese Patent Examined Publication Nos. 12246/1969, 21818/1971 and 22208/1970, as well as Japanese Patent Unexamined Publication No. 37112/1983, disclose methods for adjusting compositions of molten metals by injecting gases and/or powders into the molten metals which are under vacuum degassing process. The effect or efficiency of supply of the powder into molten metal is improved by increasing the chance of contact between the powder and the molten metal, i.e., the area and time of contact. The injecting of a gas and/or the powder strengthens the stirring of the molten metal without any risk of mixing with converter slag, thereby improving the purity and shortening the treating time.

The known system for injecting a gas and/or powder into molten steel employs an elongated lance which is mounted on a lance lift truck which is mounted at a predetermined inclination angle and is capable of moving up and down while rotating the lance. The distal end portion of the lance is immersed in the molten steel so as to be able to insert the gas and/or the powder into the molten steel. In order to maximize the effect of injecting the gas and/or the powder, it is necessary that the whole part of the gas and/or the powder is inserted into the molten steel without allowing them to escape outside the immersed portion of riser tubes in the vacuum degassing vessel, and also that the lance, which is subjected to heavy wear due to its task for strongly stirring hot molten steel, can be repaired or renewed safely and easily any time such a demand exists. Unfortunately, however, the conventional systems cannot satisfactorily meet these requirements, due to presence of various problems. Therefore, hitherto, it has been practically difficult to maximize the effect of addition of the gas and/or the powder.

More specifically, in the conventional system, the support for the vertical guide rails for guiding the movement of the lance is fixed to the column of the vacuum degassing vessel, so that the repair or renewal of the lance requires a suspension of operation of the vacuum degassing and manual labour under a severe condition in a restricted space. In addition, the operation of the lance has to be stopped even when there is no defect in the lance, whenever the refractories on the vacuum degassing vessel are repaired. Thus the rate of operation of the vacuum degassing vessel is decreased to cause a serious reduction in the yield, whenever the refractories of the vessel and/or the lance are repaired or renewed. On the other hand, the vessel or the lance has to be kept out of operation for a long time so that it is subjected to a drastic temperature change and, hence, experiences a heavy spalling, resulting in a shortened life of the refractories and, hence, a further reduction in the yield.

If the gas and/or powder inserted through the lance escapes outside the immersed portion of the riser tube in the vacuum degassing vessel, the treating time is impractically prolonged and the purification effect is reduced undesirably, while causing various problems or drawbacks such as the boiling of the molten steel surface, heavy wear of the vessel and heavy deposition of metals. For the purpose of shortening the treating time or enhancing the purifying effect, it is a common measure to increase the inserting rate of the gas and/or the powder and to increase the depth of insertion. This measure, however, tends to increase the escape of gas and the powder.

It is, therefore, highly desirable that the position of inserting of the gas is adjustable regardless of the operating condition, in order to avoid any escape of the gas and the powder. In the known system described hereinbefore, the adjustment of the inserting position is afforded only by rotation of the lance about its axis and the lift of the lance truck which is inclined at a predetermined angle and movable up and down along the guide rails. Thus, from the view point of eliminating the escape of the gas and the powder, the conventional system does not have any function for optimizing the inserting position in relation to variance in various factors such as the production and mounting precision of the lance, change in the inserting direction of the lance, rate of inserting of the gas and/or the powder, solid-to-gas ratio, flow of the molten steel, and so forth.

SUMMARY OF THE INVENTION

According to the invention, there is provided a lance supporting apparatus comprising: a turntable rotatable within a plane; and a plurality of lance operation units mounted on the turn table, each of the lance operation units detachably supporting a lance for inserting a gas and/or a powdered treating agent into a molten metal and having mechanisms for lifting/lowering, rotating and tilting the lance.

In a preferred form of the invention, the lance turntable is disposed within the central hollow or cavity of a doughnut-shaped turntable which supports a plurality of vacuum degassing vessels.

According to the invention, as the lance turntable is rotated, a lance operation unit supporting a spent lance is moved from the melt treating position to a lance replacing position, while a lance operation unit carrying a new lance is moved from the lance replacing position or from a waiting position to the melt treating position, whereby the renewal of the lance can be conducted in a short time without substantial dead time of melt treatment. In addition, the replacement of the lance can be conducted at the lance replacing position which is remote from the melt treating position and, hence, safety and good condition for labour are ensured.

The lance operation unit is adapted to drive a lance downwardly into a melt container which has been set at a melt treating position from a position on one side thereof to drive the lance to a predetermined position on one side of a melt container which has not been set yet at the melt treating position. In order to attain safe and efficient operation of the molten metal treating system, it is necessary that the insertion port of the lance is so positioned as not to cause any escape of the gas and/or the powder to the region outside the riser tube of the vacuum degassing vessel, thus assuring that whole part of the gas and/or powder is introduced into the riser tube without fail. To this end, the inserting position where the insertion port of the lance is to be located is determined in accordance with various factors such as the kinds and amounts of the gas and the powder for attaining the desired molten metal composition, the depth of immersion of the riser tube of the vacuum degassing vessel, and the opening area of the riser tube for sucking the molten metal. Then, the angle of inclination of the lance is adjusted by a tilting device, in accordance with a previously obtained relationship between the inserting position and the present position of the lance, and then the lifting/lowering device is operated to effect a downward stroking of the lance by a predetermined amount, thereby setting the lance. If necessary, after the setting of the lance, the state of insertion of the gas is examined and, in case of any escape to the region outside the riser tube, the position of the insertion port of the lance is re-adjusted by means of the above-mentioned devices.

When the lance has been worn down and spent, the lance turntable is rotated to bring the lance operation unit carrying this lance to a replacing/repairing position, where the worn lance is lowered and placed on a lance replacing truck or a similar receiving device. Then, a new lance is raised to and held at a predetermined level, thus preparing for the use in the vacuum treatment of the molten metal. The demounting of the worn lance and the mounting of the new lance are conducted by precise operation of the lance lifting/lowering device, lance rotating device and the lance tilting device of the lance operation unit, thus attaining a rapid and safe renewal of the lance. In the case where the vacuum degassing vessel is used in combination with a ladle situated under the vessel, it is preferred that a plurality of the vacuum degassing vessels are replaceably placed on a doughnut-shaped vessel turntable, and the lance turntable carrying a plurality of the lance operation units is disposed for rotation in a place within the central hollow or the cavity in the vessel turntable, while ladles are placed on a ladle turntable which is independently rotatable within a plane so as to convey successive ladles from a delivery position to the melt treating position. With this arrangement, it is possible to conduct the replacement, repair and pre-heating of the lane, vacuum degassing vessel and the ladle, any time such a work is required, without suffering from interference.

DESCRIPTION OF THE PREFERRED EMBODIMENTS

Figure 1:
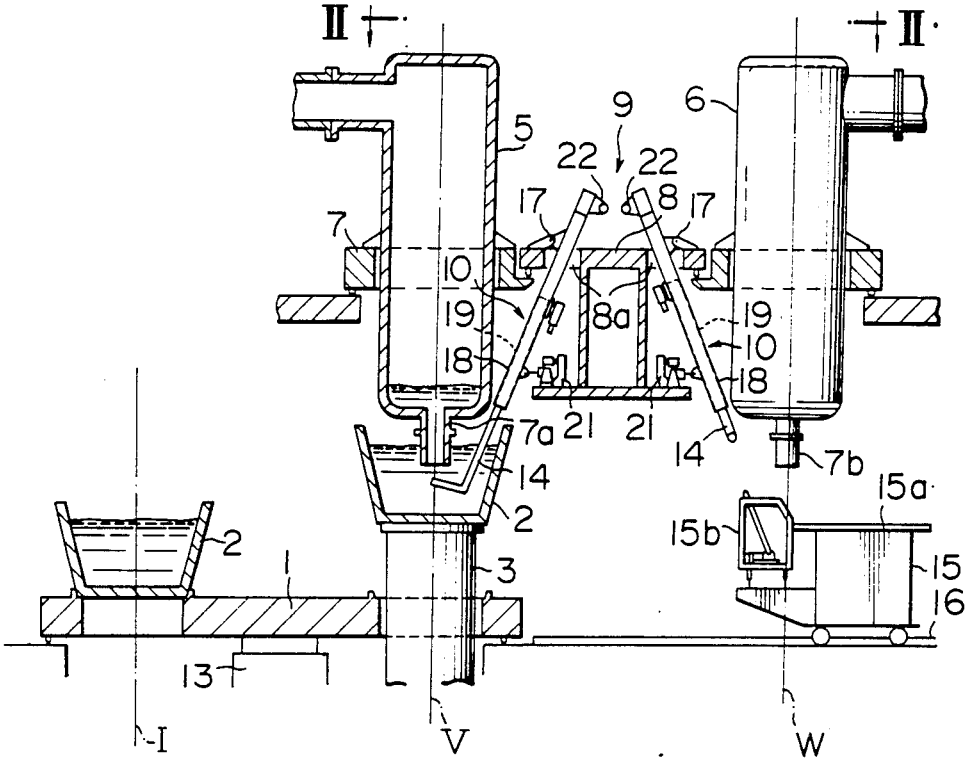
FIG. 1 is a schematic side elevational view of an RH vacuum degassing equipment.
Figure 2:
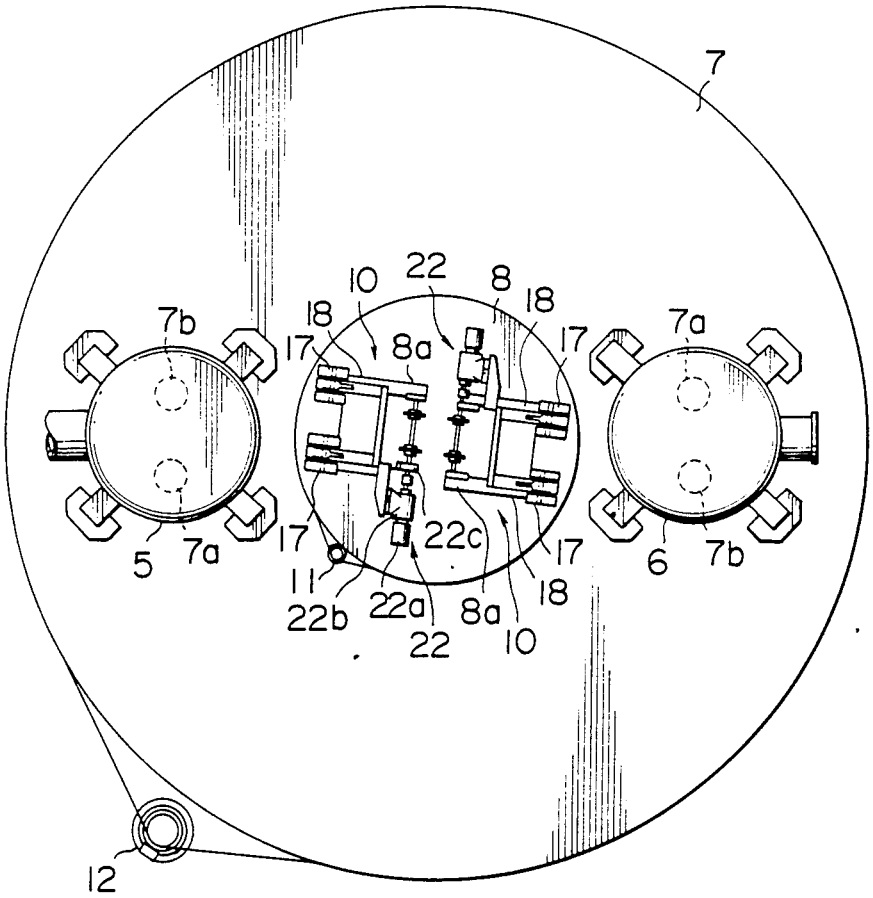
FIG. 2 is a plan view as viewed in the direction of arrows II—II in FIG. 1.
Figure 3:
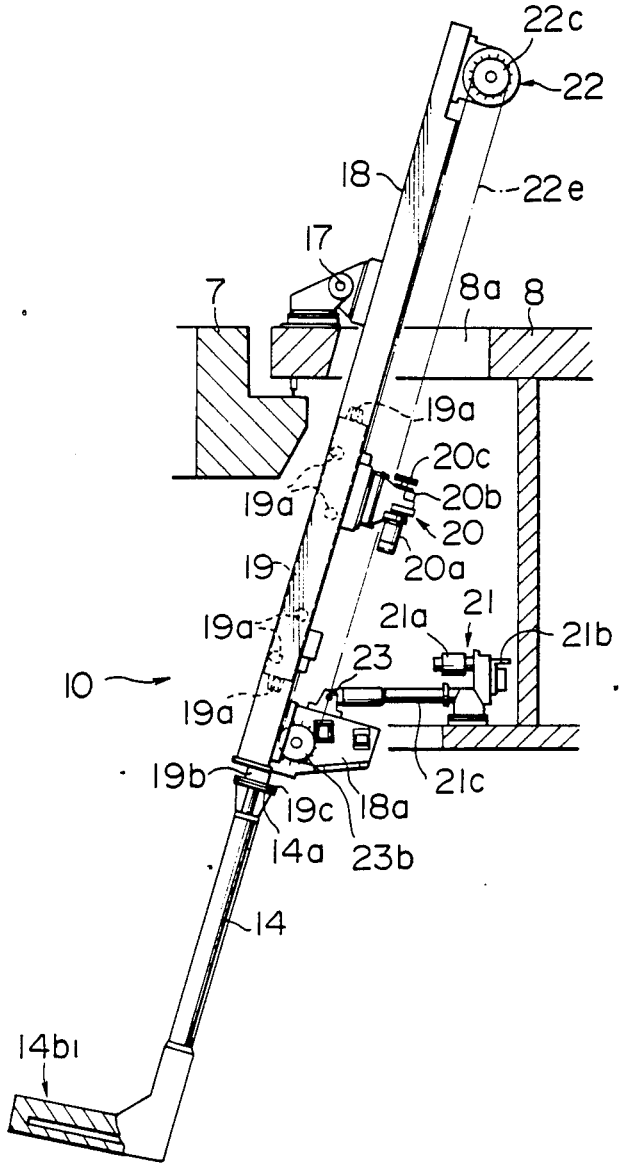
FIG. 3 is a side elevational view of a lance supporting device shown in FIG. 1.
Figure 4:
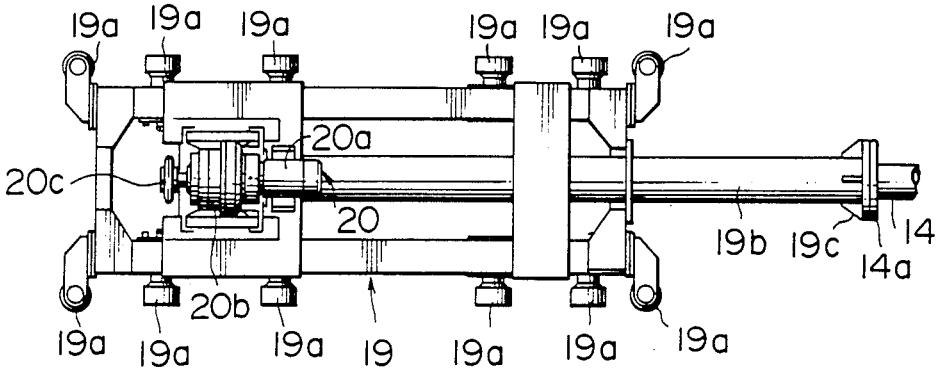
FIGS. 4 and 5 are a side elevational view and a plan view of a lance lifting/lowering truck.
Figure 5:
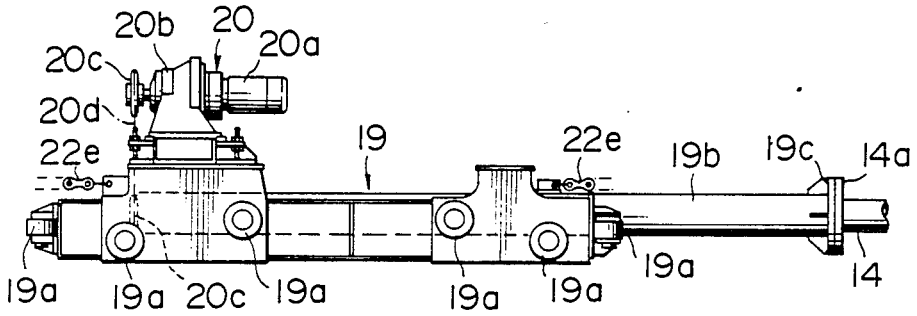

Referring to FIGS. 1 and 2, a ladle turntable 1 is situated on the ground and is driven by a driving device 13. Ladles 2 are successively delivered by cranes to a delivery position I on the ladle turntable 1. As the ladle turntable 1 is rotated, the ladles 2 are successively brought from the delivery position I to a vacuum treating position V. A ladle lifting device 3 lifts the ladle 2, which has been brought to the vacuum treating position by the ladle turntable 1, so that the lower end poritions of a riser tube 7*a* and a down comer tube 7*b* are immersed in the melt within the ladle 2. The riser tube 7*a* and the down comer tube 7*b* are switchable as desired. In FIG. 1, the down comer tube 7*b* is hidden behind the riser tube 7*a*.

A vessel turntable 7 has a generally doughnut-like form and detachably mounts a plurality of vacuum vessels 5 and 6. The vessel turn table 7 is adapted to be turned by a rotary driving device 12 so as to move the vacuum vessels between the vacuum treating position V and a waiting position W where replacement or repair is conducted.

A lance turn table 8 of the lance supporting apparatus 9 is rotatably disposed in the central hollow or cavity of the doughnut-shaped vesel turntable 7, and carries a plurality of lance operation units 10. The lance turntable 8 is adapted to be rotated by a rotary driving device 11 so as to move the lances 14 between the vacuum treating position V and the waiting position W where replacement or repair is conducted. Each of the lance operation unit 10 has a function for lifting, rotating and tilting the lance as will be described hereinunder. A replacement/repair truck 15 is adapted to run along rails 16 which are situated on the ground under the waiting position W. The replacement/repair truck 15 has a carrier 15*a* which is used for replacement or repair of lower portion of the vacuum degassing vessel or for carrying a pre-heating device for the vacuum degassing vessel, and a lance replacing truck 15*b* which traversably carries a new or used lance.

As will be seen from FIGS. 1 to 5, each lance operation unit 10 has an upper end portion which is projected above the lance turn table 8 through each notch 8*a* formed therein, and is pivotally supported by each pivot 17 on the lance turntable 8. Each lance operation unit 10 has a lifting/lowering guide rail 18 having a U-shaped cross-section and connected at its lower end to a tilting device 21 on the lower end portion of the lance turntable 8, a lance suporting rod 19*b*, a lance rotation device 20 for rotatingly driving the lance supporting rod 19*b*, a lance lifting/lowering truck 19 having wheels 19*a* for engagement with the inner surface of the guide rail 18 and rotatably carrying the lance supporting rod 19*b*, and a lifting/lowering driving device 22 which is secured to the lifting/lowering guide rail 18 and adapted to lift and lower the lance lifting/lowering truck 19.

The tilting device 21 for the lifting/lowering guide rail 18 includes an electric motor 21*a*, a reduction gear 21*b*, and a screw-type extension shaft 21*c* which is pivotally secured to a lower member 18*a* of the lifting/lowering guide rail 18 as at 23. The arrangement is such that, as the electric motor 21*a* operates, the lifting/lowering guide rail 18 is tilted within a predetermined angular range about the pivot 17, whereby the tilting angle of the lance 14 supported by the lance supporting rod 19*b* is adjusted. The rotary driving device 20 for the lance supporting rod 19*b* includes an electric motor 20*a*, speed reduction gear 20*b*, sprocket wheel 20*c*, chain 20*d* and a sprocket wheel 20*e* (see FIG. 5) fixed to the rear end of the lance supporting rod 19*b*. The arrangement is such that, as the electric motor 20*a* operates to rotate the lance supporting rod 19*b*, the L-shaped lance 14, which has a rear flange 14*a* coupled to a flange 19*c* on the extreme end of the lance supporting rod, is rotated so as to vary the position of an insertion tube 14*b* on the lower end thereof.

The lifting/lowering driving device 22 for driving the lance lifting/lowering truck 19 is provided on the lifting/lowering guide rail 18 as described before. The lifting/lowering driving device 22 has an electric motor 22*a* fixed to the upper end of the lifting/lowering guide rail 18, a speed reduction gear 22*b*, a sprocket wheel fixed to the output shaft of the speed reduction gear 22*b*, a sprocket wheel 23*b* rotatably provided on the lower end of the lifting/lowering guide rail 18, and a chain 22*e* wound round the sprocket wheel. The chain 22*e* is connected at its one end to the rear end of the lance lifting/lowering truck 19 and at its other end to the front end of the lance lifting/lowering truck 19. As the electric motor 22*a* operates, the lance lifting/lowering truck 19 is moved up and down, thereby lifting or lowering the lance 14.

Figure 6:
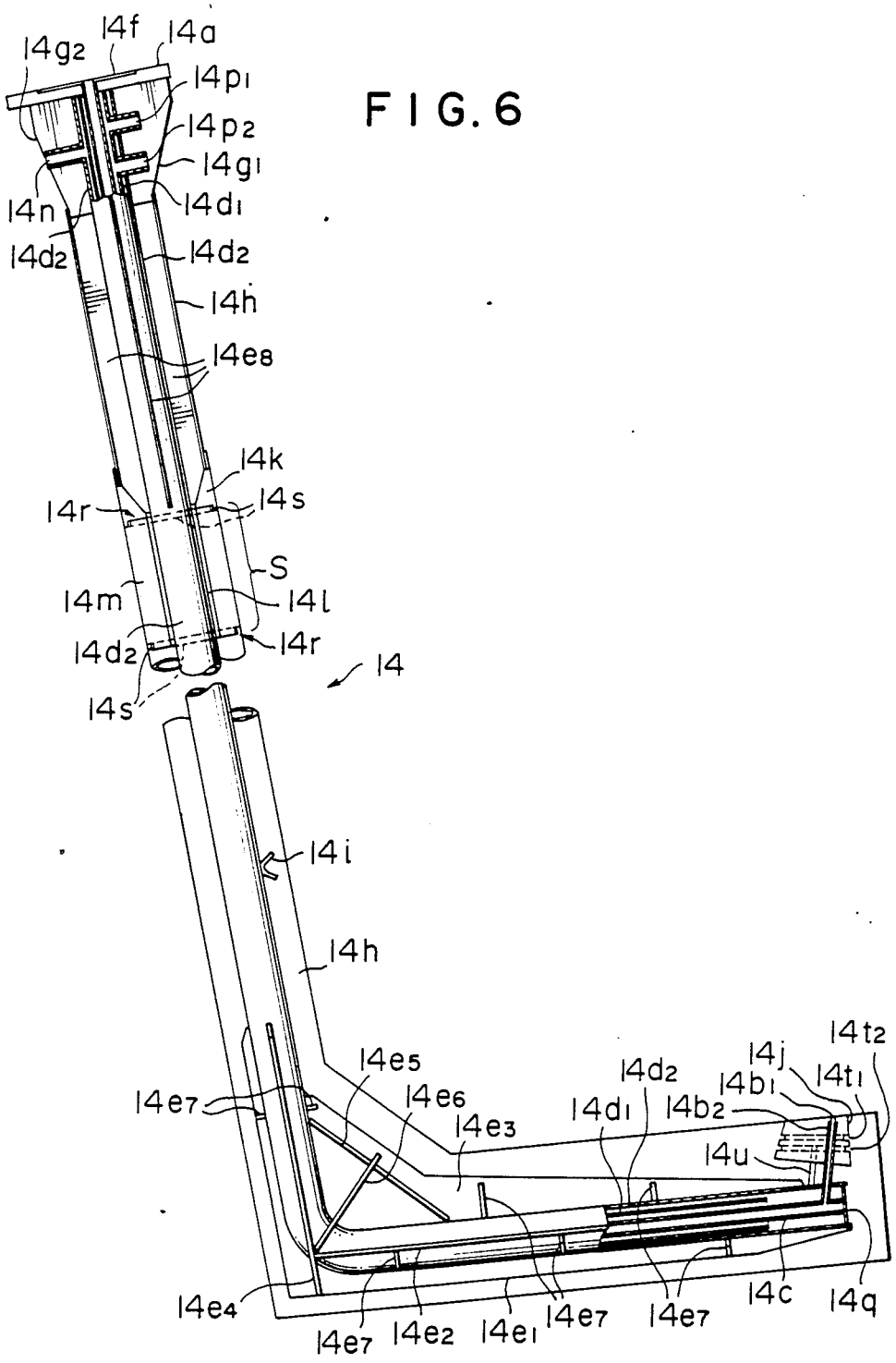
FIG. 6 is a longitudinal sectional view of a lance showing the detail of the construction of the lance.

Referring specifically to FIG. 6, the L-shaped lance 14 is constituted by numerous parts as follows: a rear end support flange 14*f* fixed to the aforementioned flange 14*a;* an insertion tube 14*b*2 through which a powder is inserted by means of a carrier gas; a powder transfer pipe 14*c* made of a stainless steel and adapted to transfer the powder together with the gas; an MgO-C brick provided around the end of the insertion tube 14*b*2; cooling pipes 14*d*1, 14*d*2 doubly arranged around the transfer pipe 14*c;* reinforcement ribs 14*e*1 to 14*e*7 provided on the outer periphery of the front portion of the cooling pipe 14*d*2; reinforcement ribs 14*e*8 provided around the rear portion of the cooling pipe 14*d*2; support ribs 14*g*1, 14*g*2 through which the rear end of the cooling pipe 14*d*2 is connected to the rear ends of the reinforcement ribs 14*e*8; a tubular pipe 14*h* having an inner surface fixed to the radially outer end surfaces of the reinforcement ribs 14*e*8; studs 14*i* fixed to the outer peripheral surface of the cooling pipe 14*d*2 at a suitable interval; a refractory material 14*k* disposed on the whole outer peripheral surface of the cooling pipe 14*d*2 except the portions where the reinforcement rib 14*e*8 and the slag line portion S are provided, so as to cover the studs 14*i* and the reinforcement ribs 14*e*1 to 14*e*7; a padding member 14 provided around the cooling pipe 14*d*2 of the slag line portion S and made of a heat-conductive material having a high heat conductivity not smaller than 1.5 kcal/mh°C.; and $MgO\text{-}Cr_2O_3$ refractory bricks 14*m* arranged in the circumferetial direction of the padding material.

The cooling pipe 14*d*2 is connected at its rear end to a cooling fluid supply pipe 14*n*, while the front end of this cooling pipe 14*d*2 is closed by means of a closure plate 14*q*. The cooling pipe 14*d*1 has its rear end connected to cooling fluid discharge pipes 14*p*1, 14*p*2, while the front end thereof is opened. The front end opening is positioned between the outer peripheral surface of the front portion of the transfer pipe 14*c* and the inner peripheral surface of the front portion of the cooling pipe 14*d*2, thus forming a return passage for the cooling gas.

Before the placement of the refractory material 14*k*, the refractory bricks 14*m* are fixed by means of metallic bands 14*s* which are tightened in annular recesses 14*r* formed in upper and lower portions of these bricks.

The buyere brick 14*j* is provided with a couple of annular recesses 14*t*1, 14*t*2 in its outer peripheral surface. The upper recess 14*t*1 is adapted for preventing the melt from coming into the lance, while the lower recess 14*t*2 is for engagement with hooks of a pair of tuyere retainers 14*u* provided on the outer periphery of the cooling pipe 14*d*2.

The above-described construction of the lance is only illustrative, and various known lance constructions are adoptable equally well.

The operation of the lance supporting apparatus of the invention will be described hereinunder, with reference to a typical molten steel degassing treating pattern.

The ladle 2 containing a molten steel is conveyed by a crane (not shown) onto the ladle turn table 1. As the ladle turntable 2 is rotated, the ladle 2 is moved to the vacuum treating position V immediately under the vacuum degassing tank 5. Subsequently, the lance turntable 8 is rotated so as to bring the lance operation unit 10 into alignment with the riser tube 7*a* of the vacuum degassing vessel 5 in the vacuum treating position V. Then, the rotary driving device 20 and the tilting device 21 of the lance operation unit 10 are operated so as to adjust the tilting angle and rotational position of the insertion port 14*b*1 of the insertion pipe 14*b*2 and to set the amount of downward stroke of the lance lifting/lowering truck necessary for locating the insertion port 14*b*1 of the insertion pipe 14*b*2 at the position immediately below the riser tube 7*a* of the vacuum degassing vessel 5. The lifting/lowering driving device is operated in accordance with the thus set amount of downward stroke, thereby lowering the lance lifting/lowering truck 19.

Then, the ladle 2 is lifted by the ladle lifting device 3, so that the riser tube 7*a* and the down comer tube 7*b* of the vacuum degassing vessel 5, as well as the lance 14, are immersed in the molten steel in the ladle 2. Immediately before the lance 14 is immersed, Ar gas pressurized to a pressure high enough to prevent the molten steel from flowing into the lance is inserted from the gas insertion tube 14*b*. Meanwhile, a vacuum source (not shown) communicated with the vacuum degassing vessel 5 is operated to induce the gas in the vacuum degassing vessel 5, thus evacuating the same. In consequence, the molten steel is circulated between the vacuum degassing vessel 5 and the ladle 2 by the buoyancy of the gas.

Subsequently, the lifting/lowering driving device 22, rotary driving device 20 and the tilting device 21 of the lance operation unit 10 are started and the factors are determined necessary for allowing the powder to reach a predetermined desirable position under the riser tube 7*a*, e.g., the inserting pressure of the Ar gas, downward inclination angle, rotational position of the insertion tube 14*b* and the amount of downward stroke of the lance lifting/lowering truck 19, are determined, and the insertion tube 14*b* is lowered in accordance with the thus determined factors.

If there is an escape of the Ar gas to the region outside the riser tube, the lifting/lowering device 22, rotational driving device 20 and the tilting device 21 are operated so as to adjust the position of the insertion port 14*b*1, thereby eliminating the escape. Then, the powder necessary for the vacuum treatment of the molten steel is inserted together with the Ar gas into the molten steel so as to attain the desired composition of the molten steel. After the treatment, the above-described process is reversed: namely, the pressure in the vacuum degassing vessel is recovered, the lance is extracted from the molten steel, and then the ladle 2 is lowered.

Then, the ladle turntable 1 is rotated to bring the ladle 2, with which the vacuum treatment is finished, by a crane to a next process such as continuous casting.

When the refractory material of the lance 14 and/or the vacuum degassing vessel 5 has been worn down, the lance turntable 8 and/or the vessel turntable 7 is rotated to bring the ladle 14 and/or the vacuum degassing vessel 5 to the waiting position W and required repair or replacement is conducted on the replacing/repairing truck 15.

As has been described, according to the invention, a plurality of lance operation units are mounted on the lance turntable so as to be moved between the vacuum treating position and the replacing/repairing position by the rotation of the turntable. It is, therefore, possible to conduct renewal or repair of the lance safely, surely and promptly any time such renewal or replacement is necessary, regardless of the renewal or repair of the refractories on the vacuum degassing vessel. In consequence, the long suspension of operation of the vacuum degassing vessel, which heretofore has been necessary when the lance is renewed, can be eliminated and the spalling of the refractories in the vacuum degassing vessel is reduced, thereby assuring longer life of the refractories. This in turn affords a reduction in the frequency of the renewal or repair of the vacuum degassing vessel, as well as a remarkable improvement in the capacity for the vacuum treatment of the molten steel. In fact, the interval between the replacement or repair of the vacuum degassing vessel is prolonged from about 20 hours to about 60 hours, and the treating capacity is increased from 150,000 tons to 400,000 tons per vessel.

In addition, according to the invention, the depth and position of the insertion port of the lance can be optimized for varying demands by different types of steel to be treated, by virtue of the rotation of the lance turntable, rotation of the lance about its axis, and lifting and tilting of the lance. This in turn eliminates the risk of escape of the gas or powder to the region outside the riser tube of the vacuum degassing vessel during the vacuum treatment, so that the whole part of the gas and the powder inserted from the lance are introduced into the riser tube thereby enhancing the rate of circulation of the molten steel, while avoiding boiling at the surface of the molten steel in the ladle, as well as troubles such as melting down of flanges and other parts of the vacuum degassing vessel. Moreover, the effect and speed of reaction between the powder and the molten steel are maximized thereby assuring the production of molten steel of high quality at a high yield and without fail.

What is claimed is:

1. A lance supporting apparatus comprising:

a rotatable doughnut-shaped turntable for supporting a plurality of vacuum degassing vessels;

a circular turntable rotatable within a plane and disposed in an area within the inner diameter portion of said doughnut-shaped turntable; and a plurality of lance operation units mounted on said circular turntable, each of said lance operation units detachably supporting a lance for inserting a gas and/or powdered treating agent into a molten metal, said lance operation units having mechanisms for lifting, lowering, rotating and tilting said supported lance.

* * * * *